US009068732B2

(12) United States Patent
Lin et al.

(10) Patent No.: US 9,068,732 B2
(45) Date of Patent: Jun. 30, 2015

(54) AIR-COOLED LED LAMP BULB

(71) Applicant: UniLED Lighting TW., Inc., New Taipei (TW)

(72) Inventors: Ming-Te Lin, New Taipei (TW); Ming-Yao Lin, New Taipei (TW); Heng Qiu, Kaosiung (TW)

(73) Assignee: UNILED LIGHTING TW., INC, New Taipei (TW)

( * ) Notice: Subject to any disclaimer, the term of this patent is extended or adjusted under 35 U.S.C. 154(b) by 119 days.

(21) Appl. No.: 13/853,647

(22) Filed: Mar. 29, 2013

(65) Prior Publication Data

US 2014/0293599 A1 Oct. 2, 2014

(51) Int. Cl.
*F21V 29/00* (2006.01)
*F21K 99/00* (2010.01)

(52) U.S. Cl.
CPC ..... *F21V 29/004* (2013.01); *F21K 9/13* (2013.01)

(58) Field of Classification Search
USPC ..... 362/650, 240, 249.01, 249.02, 294, 373
See application file for complete search history.

(56) References Cited

U.S. PATENT DOCUMENTS

| | | | | |
|---|---|---|---|---|
| 7,314,291 | B2 * | 1/2008 | Tain et al. | 362/294 |
| 7,670,029 | B1 * | 3/2010 | Luo et al. | 362/294 |
| 7,766,512 | B2 * | 8/2010 | Chou et al. | 362/294 |
| 7,789,534 | B2 * | 9/2010 | Wang | 362/294 |
| 7,874,700 | B2 * | 1/2011 | Patrick | 362/294 |
| 7,950,829 | B2 * | 5/2011 | Chiu et al. | 362/294 |
| 8,226,273 | B2 * | 7/2012 | Lai | 362/294 |
| 8,414,160 | B2 * | 4/2013 | Sun et al. | 362/294 |
| 8,425,086 | B2 * | 4/2013 | Chen et al. | 362/294 |
| 8,525,395 | B2 * | 9/2013 | Muessli | 362/294 |
| 8,556,467 | B1 * | 10/2013 | Lin | 362/294 |
| 8,608,341 | B2 * | 12/2013 | Boomgaarden et al. | 362/294 |
| 8,616,714 | B2 * | 12/2013 | Lee et al. | 362/294 |

* cited by examiner

*Primary Examiner* — Ismael Negron
(74) *Attorney, Agent, or Firm* — Lowe Hauptman & Ham, LLP

(57) ABSTRACT

An air-cooled lamp bulb includes a central tube, a circuit board disposed inside the central tube, a circular light wall surrounding the central tube, a transparent dome surrounding a top end of the circular light wall and having a top central opening, and a first air passage formed between the central tube and the circular light wall. The circular light wall is formed by a plurality of light units arranged side by side. Each of the light units has a light source mounted adjacent a top end of the central tube. The transparent dome is arranged for modifying light emitted by the light sources. The first air passage allows air flow through the air-cooled lamp bulb.

15 Claims, 12 Drawing Sheets

AIR-COOLED LED LAMP BULB

BACKGROUND

1. Technical Field

The present invention relates to a lamp, especially an air cooling LED lamp which has air passages for natural cooling the lamp without using an electric fan.

2. Description of Related Art

FIG. 1 is a prior art

FIG. 1 shows a prior art, it discloses an LED lamp with an electric fan for cooling the lamp. The LED 5 is mounted on a support 4. Cooling air 8 is guided through openings 11 in the lamp base 2 to electric fan 6 and blown out through a cavity 12 of the support 4 upward as discharge stream 9. Cooling fins 13 for reinforced cooling of the support 4 are arranged in cavity 12. By cooling the support 4, the power demand of the LED lamp can be increased.

The deficiency of the prior art is to use an electric fan 6 for the cooling. Running of the electric fan 6 consumes electric energy. It is desired to develop a natural cooling system without using an electric fan so as to reduce electricity consumption.

DETAILED DESCRIPTION OF THE INVENTION

This invention uses air passages for cooling the led lamp without using any electric fan so that the present invention is a green product which reduces electric energy consumption.

Figure 1:
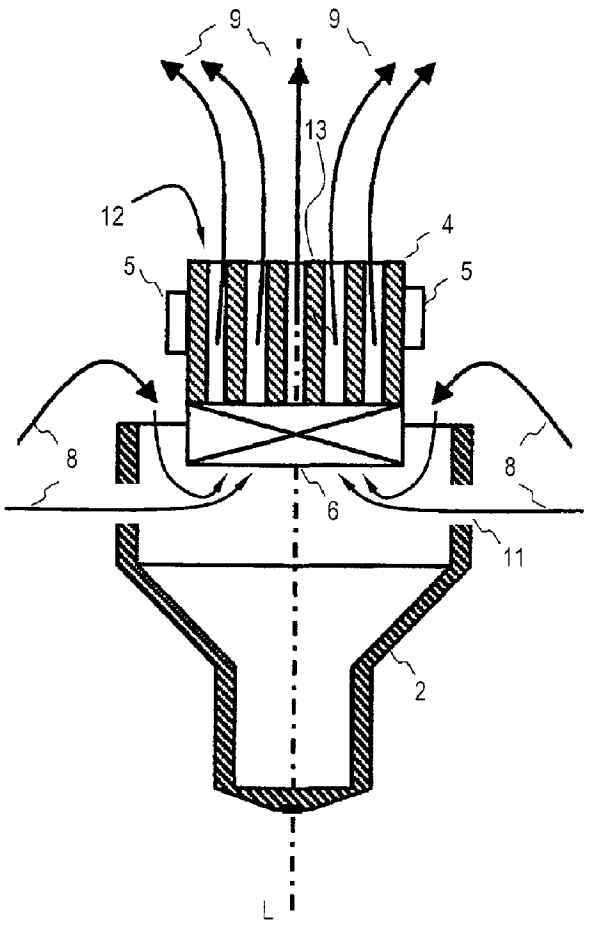
Fig.1 Prior Art
FIG. 1 is a prior art
Figure 2:
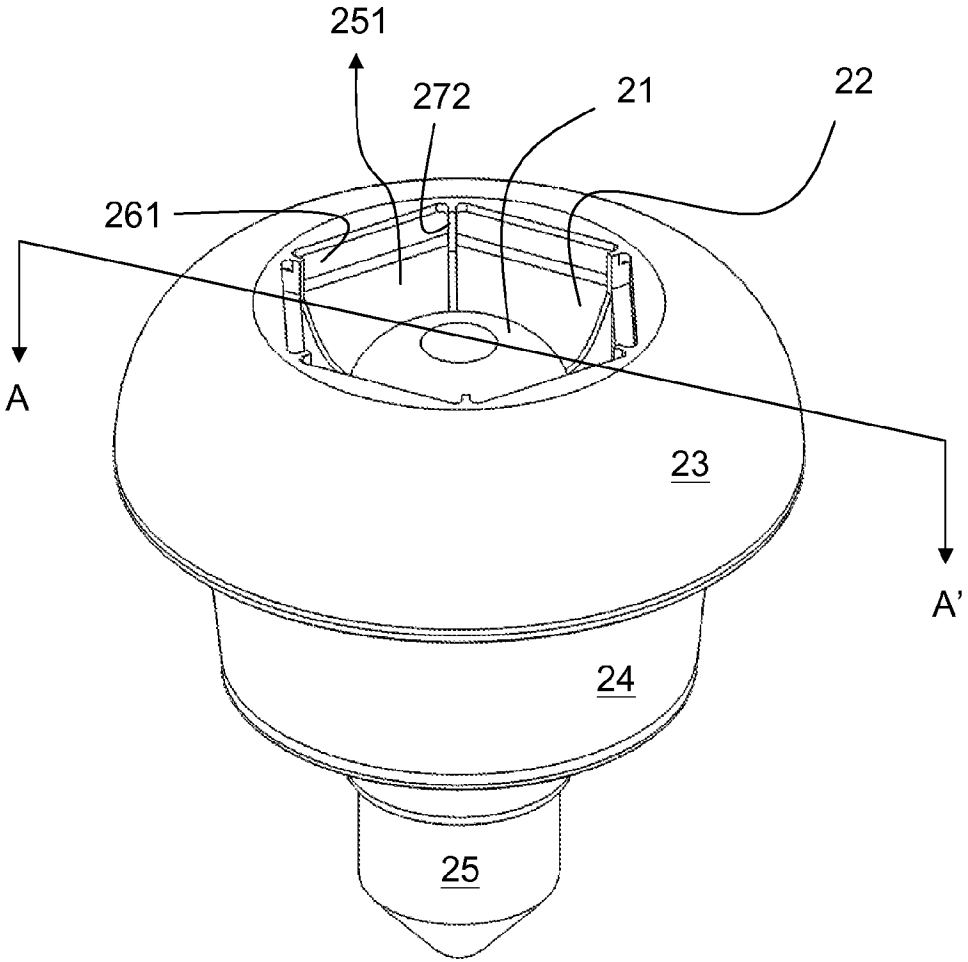
FIG. 2 is a first embodiment according to the present invention

FIG. 2 is a first embodiment according to the present invention

FIG. 2 shows an LED lamp bulb, which has a central tube 21 for housing circuit board and other electronic elements. A circular light wall 22 encloses the central tube 21. An air passage 251 is formed between the central tube 21 and the light wall 22 for a natural air-flow bottom up. A lamp base 25 is configured on a bottom of the central tube 21 for being able to mount the lamp to a conventional lamp socket. A top gap 261 is configured on a top of the light wall 22 for air flow. Top rib 272 is used for fixing the position between the light wall and the transparent dome 23. A trumpet cup 24 is configured under the transparent dome 23.

Figure 3A:
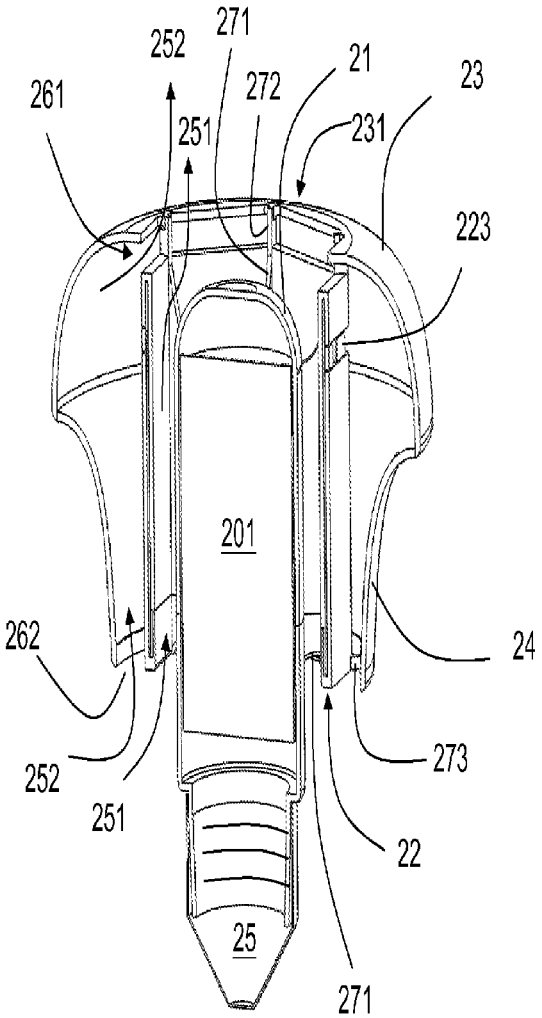
FIG. 3A is a section view of FIG. 2

FIG. 3A is a section view of FIG. 2

FIG. 3A is a section view of the lamp according to line AA' shown in FIG. 2. The section view shows a central tube 21 having circuit board 201 and other electronic elements (not shown) inside. A circular light wall 22 is composed of a plurality of light unit 221 that are configured side by side. The circular light wall 22 surrounds the central tube 21. Each of the light units 221 has a light source 223 mounted on a top end facing outward. A transparent dome 23 surrounds a top of the circular light wall 22 for modifying light beams of the light unit 221 before emitting. A central cavity 231 is configured on a top center of the transparent dome 23.

A first air passage 251 is formed between the central tube 21 and the circular light wall 22 for air flow. A trumpet cup 24 is configured under the transparent dome 23, surrounds lower part of the circular light wall 22. A top gap 261 is configured between a top end of the transparent dome 23 and a top end of the circular light wall 22. The top gap 261 communicates with the central cavity 231. A bottom gap 262 is configured between a bottom of the circular light wall 22 and a bottom of the trumpet cup 24. A second air passage 252 communicates between the top gap 261 and the bottom gap 262 for air flow.

An inner rib 271 is configured between the central tube 21 and the circular light wall 22 for fixing a position between the central tube 21 with reference to the circular light wall 22. An outer rib 273 is configured between the circular light wall 22 and a trumpet cup 24 for fixing a position between the circular light wall 22 and the trumpet cup 24. A top rib 272 is configured between a top end of the circular light wall 22 and a top end of the transparent dome 23 for fixing a position between the circular light wall 22 and the transparent dome 23.

Figures 3B, 3C:
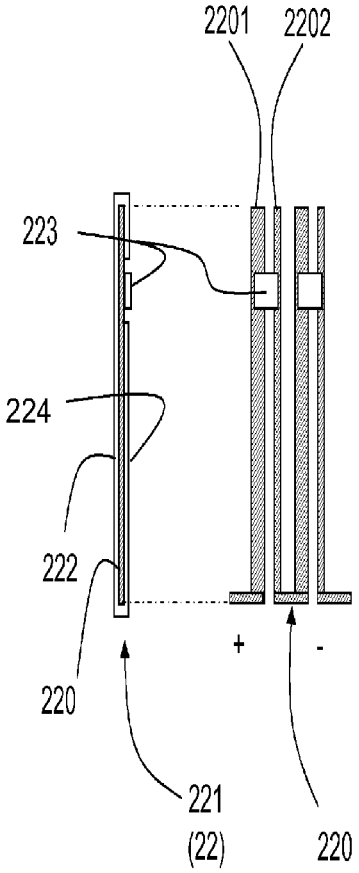
FIG. 3B is a side view of the light unit of FIG. 3A
FIG. 3C is a front view of the metal strip of FIG. 3B

FIG. 3B is a side view of the light unit of FIG. 3A. FIG. 3B shows that the light source 223, which includes an LED, is mounted on a top of the metal strip 220. A front side protection layer 221 layer 224 coated on a front side of the metal strip 220 except an area for the light source 223 to mount. A back side protection layer 222 is coated on a back side of the metal strip 220.

FIG. 3C is a front view of the metal strip of FIG. 3B

FIG. 3C shows the structure of a metal strip 220 of the light unit 221. A pair of metal strips 2201, 2202 is parallel configured. The light source 223 is straddled on a top of the metal strips 2201, 2202.

Figure 4:
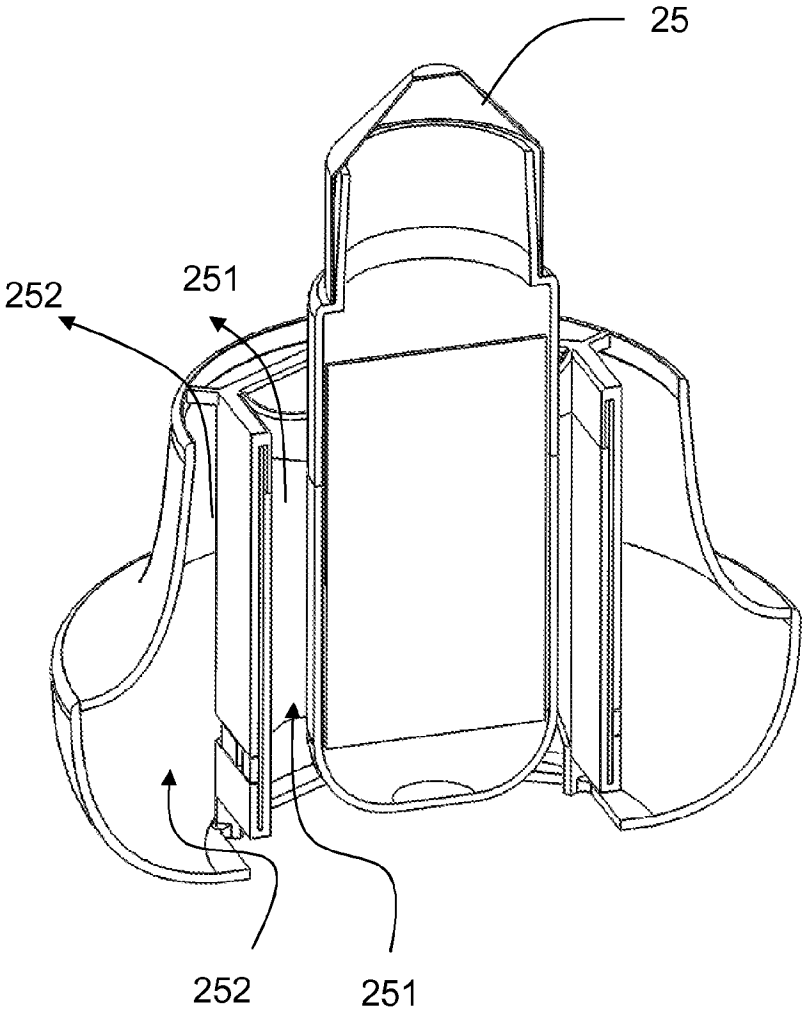
FIG. 4 is a reversed position of the lamp of FIG. 3A

FIG. 4 is a reversed position of the lamp of FIG. 3A

FIG. 4 shows when the lamp of FIG. 3A is configured in a reversed position, the first air passage 251 and the second air passage 252 still work for the air flow cooling bottom up.

Figure 5:
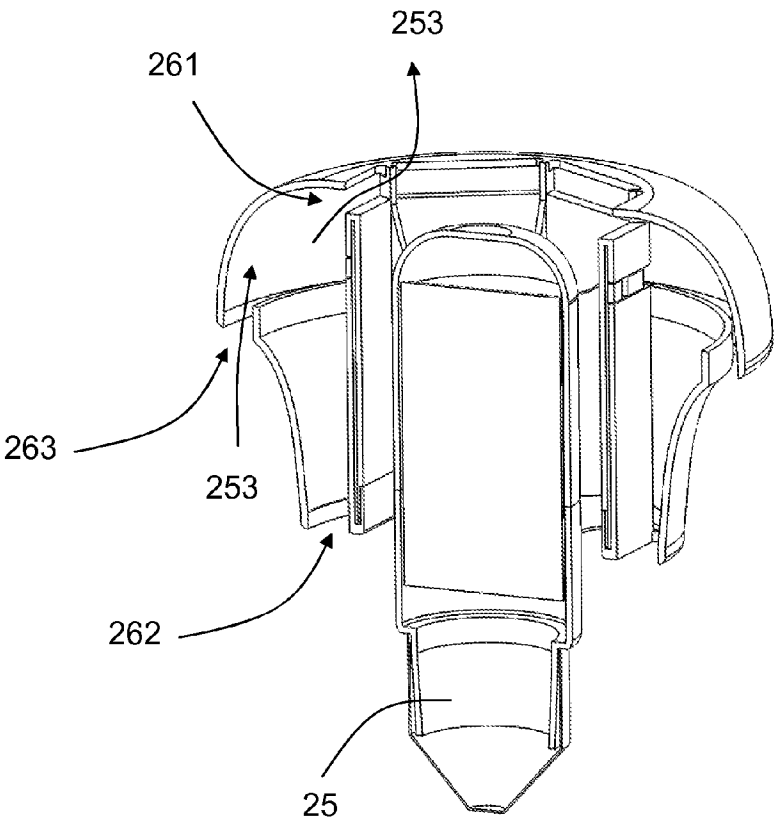
FIG. 5 is a second embodiment according to the present invention

FIG. 5 is a second embodiment according to the present invention

FIG. 5 is a modified lamp of FIG. 3A. FIG. 5 shows that a side gap 263 is configured between a bottom end of the transparent dome 23 and a top end of the trumpet cup 24. A third air passage 253 communicates between the side gap 263 with the top gap 261 for air flow.

Figure 6:
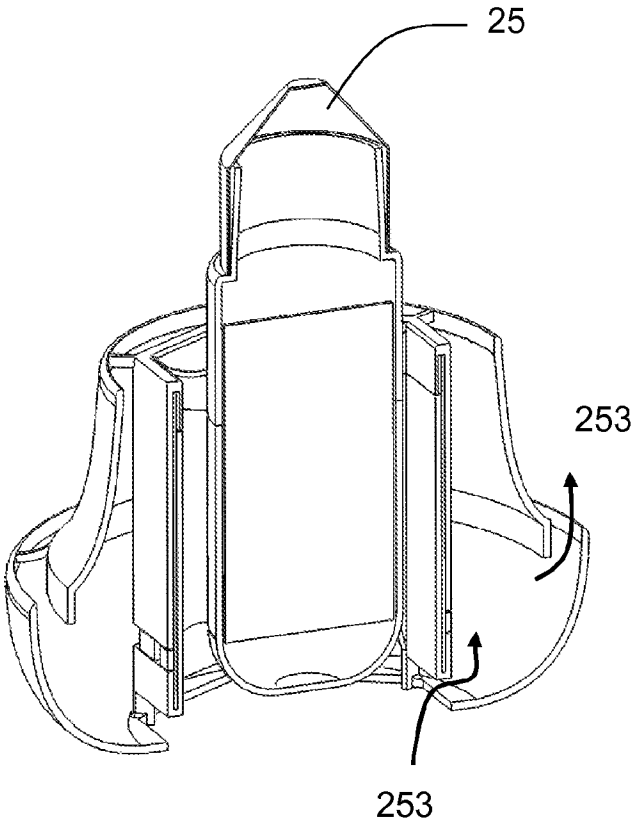
FIG. 6 is a reversed position of the lamp of FIG. 5

FIG. 6 is a reversed position of the lamp of FIG. 5

FIG. 6 shows when the lamp of FIG. 5 is configured in a reversed position, the third air passage 253 still work for the air flow bottom up.

Figure 7:
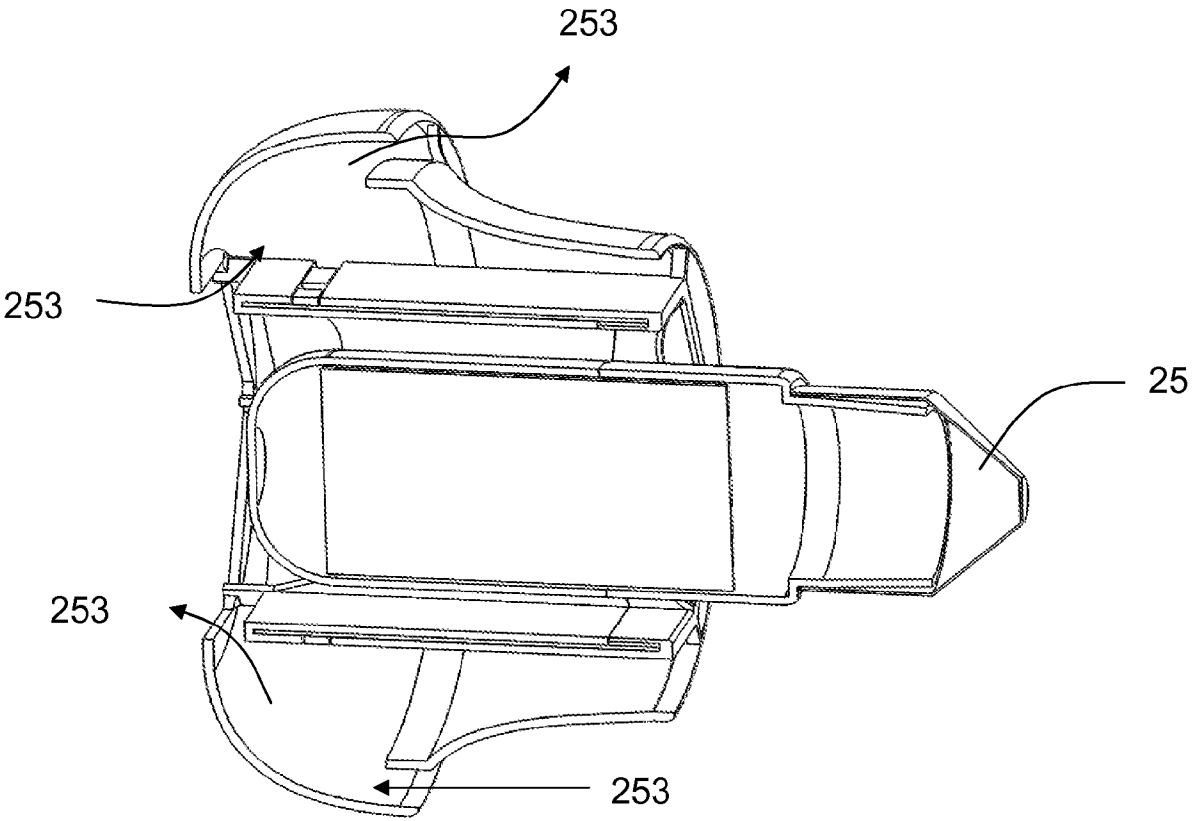
FIG. 7 is a lateral position of the lamp of FIG. 5

FIG. 7 is a lateral position of the lamp of FIG. 5

FIG. 7 shows when the lamp of FIG. 5 is configured in a lateral position, the third air passage 253 still work for the air flow bottom up.

Figure 8:
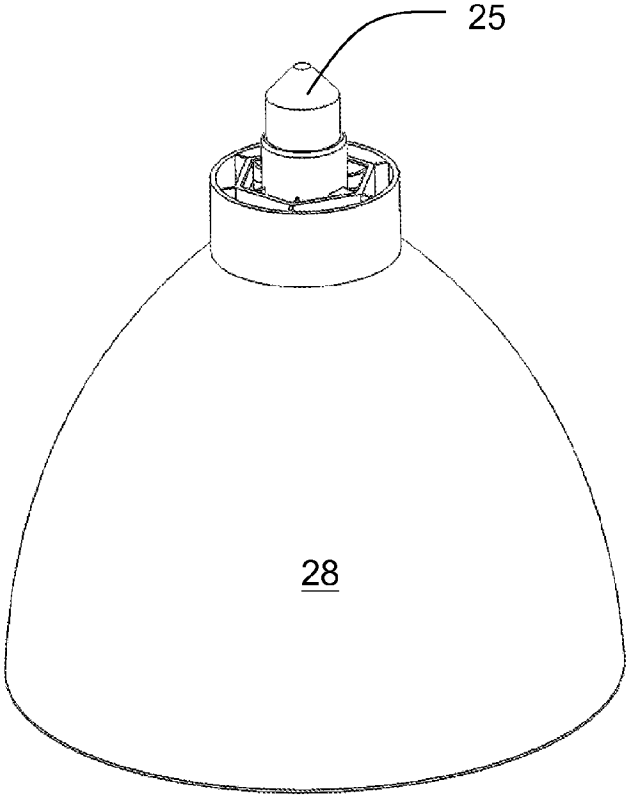
FIG. 8 is a modified embodiment according to the present invention

FIG. 8 is a modified embodiment according to the present invention

FIG. 8 shows that a reflection cup 28 is prepared to cover the lamp as a lampshade for modifying the light direction of the light source 223 before emitting.

Figure 9:
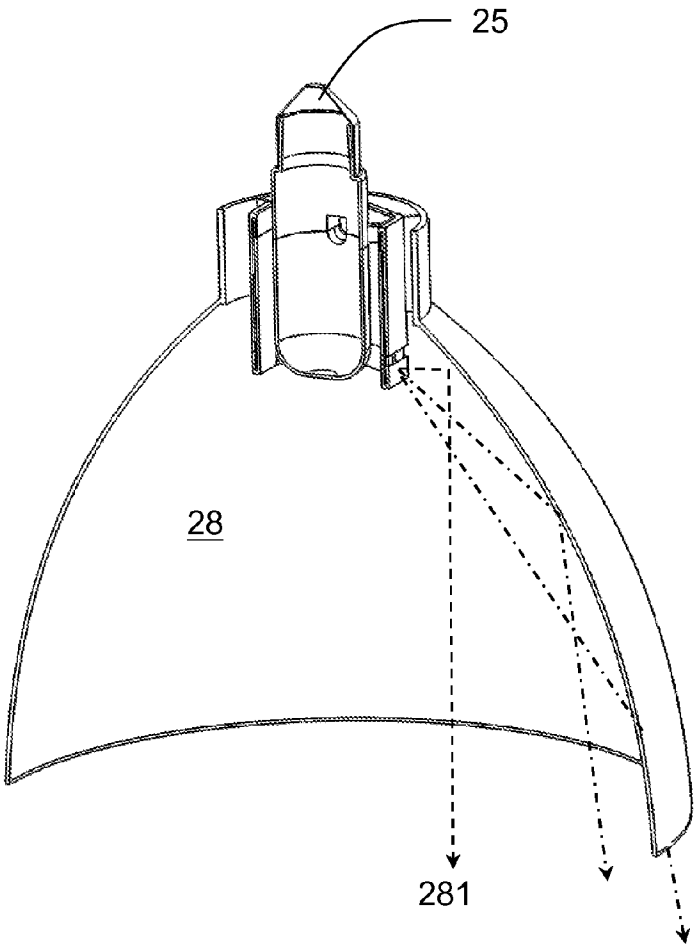
FIG. 9 is a section view of FIG. 8

FIG. 9 is a section view of FIG. 8

FIG. 9 shows the direction of the light beams 281 have been modified by the inner wall of the reflection cup 28 before the light beams exiting the lamp.

Figure 10:
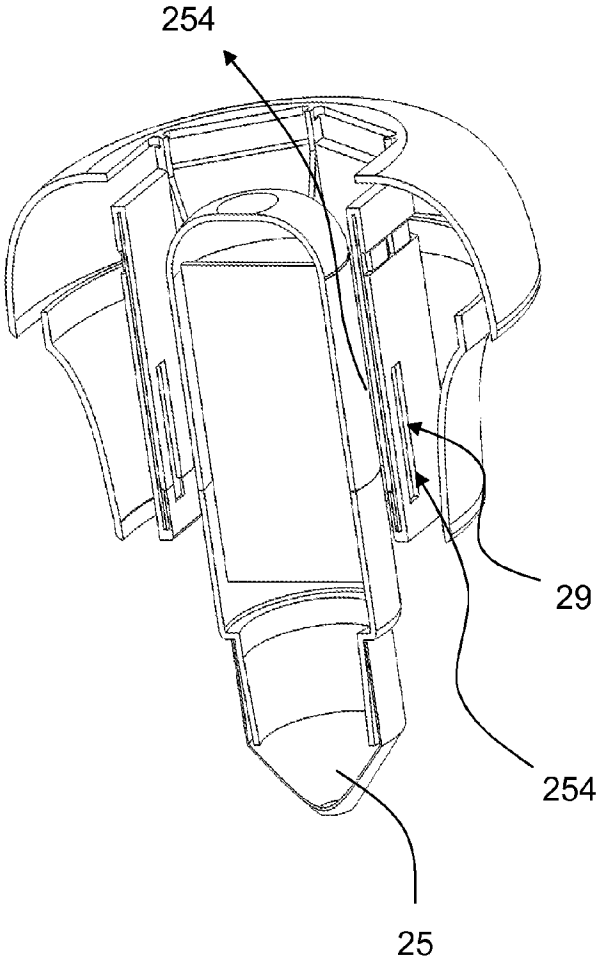
FIG. 10 is a modified lamp of FIG. 3A

FIG. 10 is a modified lamp of FIG. 3A

FIG. 10 shows that a slot 29 is configured passing through a lower portion of the light unit. A further air passage 254 is formed for air flow to enhance the cooling efficiency.

Figure 11:
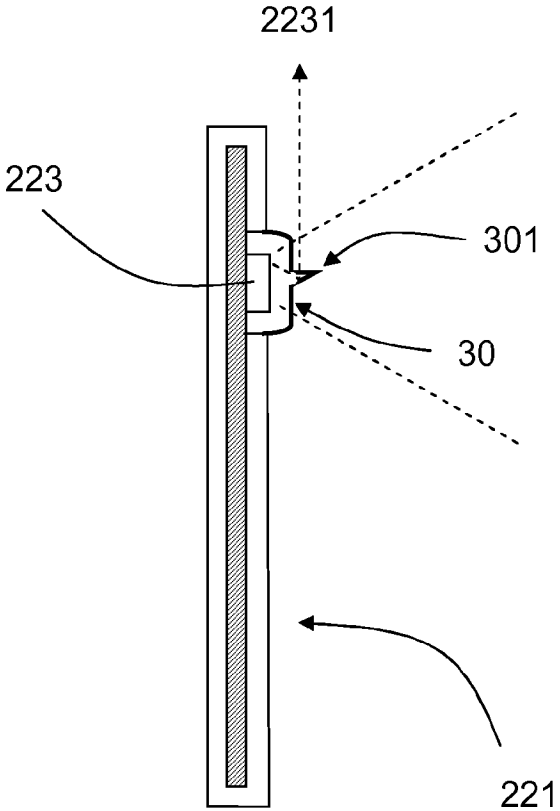
FIG. 11 is a modified light unit of FIG. 3B

FIG. 11 is a modified light unit of FIG. 3B

FIG. 11 shows that a lens 30 is configured in front of the light source 223 of the light unit 221 for compensating the light beams upward 2231. The lens 30 has a triangle extension 301 for reflecting light beam upward.

Figure 12:
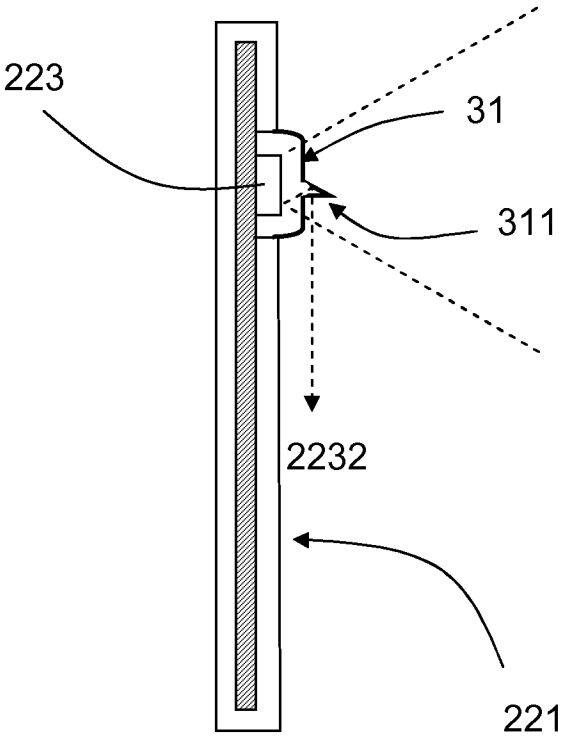
FIG. 12 is a further modified light unit of FIG. 3B

FIG. 12 is a further modified light unit of FIG. 3B

FIG. 12 shows that a lens 31 is configured in front of the light source 223 of the light unit 221 for compensating the light beams downward 2232. The lens has a triangle extension 311 for reflecting light beam downward.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. An air-cooled lamp bulb, comprising:

a central tube;

a circuit board disposed inside the central tube;

a circular light wall formed by a plurality of light units arranged side by side and surrounding the central tube, each of the light units having a light source mounted adjacent a top end of the central tube;

a transparent dome surrounding a top end of the circular light wall for modifying light emitted by the light sources, the transparent dome including a top central opening; and a first air passage formed between the central tube and the circular light wall for allowing air flow through the air-cooled lamp bulb.

2. An air-cooled lamp bulb as claimed in claim 1, wherein each of the light units further comprises:

a protection layer covering a front side and a back side of the light unit except an area for mounting the light source of the light unit.

3. An air-cooled lamp bulb as claimed in claim 1, further comprising:

a reflection cup surrounding light units for modifying directions of light emitted by the light sources.

4. An air-cooled lamp bulb as claimed in claim 1, further comprising:

a lamp base formed on a bottom end of the central tube.

5. An air-cooled lamp bulb as claimed in claim 1, wherein each of the light units further comprises:

a lens formed in front of the light source, and having a triangle extension for reflecting light downward.

6. An air-cooled lamp bulb as claimed in claim 1, further comprising:

a slot passing through a lower portion of at least one of the light units.

7. An air-cooled lamp bulb as claimed in claim 1, wherein each of the light units further comprises:

a lens formed in front of the light source, and having a triangle extension for reflecting light upward.

8. An air-cooled lamp bulb as claimed in claim 1, further comprising:

a trumpet cup formed under the transparent dome and surrounding a lower part of the circular light wall.

9. An air-cooled lamp bulb as claimed in claim 8, further comprising:

a top gap formed between a top end of the transparent dome and the top end of the circular light wall; and a bottom gap formed between a bottom end of the circular light wall and a bottom end of the trumpet cup; and a second air passage communicating the top gap and the bottom gap for allowing air flow through the air-cooled lamp bulb.

10. An air-cooled lamp bulb as claimed in claim 9, further comprising:

a side gap formed between a bottom end of the transparent dome and a top end of the trumpet cup; and a third air passage communicating the side gap with the top gap for allowing air flow through the air-cooled lamp bulb.

11. An air-cooled lamp bulb as claimed in claim 1, wherein each of the light units further comprises:

a first metal strip, and a second metal strip, wherein the light source of the light unit is straddled on top ends of the metal strips.

12. An air-cooled lamp bulb as claimed in claim 11, wherein each of the light units further comprises, on each of the metal strips:

a front side protection layer coated on a front side of the metal strip except an area where the light source is mounted; and a back side protection layer coated on a back side of the metal strip.

13. An air-cooled lamp bulb as claimed in claim 12, further comprising:

an inner rib formed between the central tube and the circular light wall.

14. An air-cooled lamp bulb as claimed in claim 12, further comprising:

a trumpet cup formed under the transparent dome and surrounding a lower part of the circular light wall; and an outer rib formed between the circular light wall and the trumpet cup.

15. An air-cooled lamp bulb as claimed in claim 12, further comprising:

a top rib formed between the top end of the circular light wall and a top end of the transparent dome.

* * * * *